US011892247B2

(12) United States Patent
Fischer et al.

(10) Patent No.: US 11,892,247 B2
(45) Date of Patent: Feb. 6, 2024

(54) WATER-SHEDDING DEVICE FOR EVAPORATOR CORES

(71) Applicant: MAHLE International GmbH, Stuttgart (DE)

(72) Inventors: Jeremy Fischer, Appleton, NY (US); Richard Baranowski, Lake View, NY (US)

(73) Assignee: MAHLE International GmbH, Stuttgart (DE)

( * ) Notice: Subject to any disclaimer, the term of this patent is extended or adjusted under 35 U.S.C. 154(b) by 23 days.

(21) Appl. No.: 17/543,813

(22) Filed: Dec. 7, 2021

(65) Prior Publication Data

US 2023/0175790 A1 Jun. 8, 2023

(51) Int. Cl.

| | |
|---|---|
| ***F28F 1/12*** | (2006.01) |
| ***F25D 21/14*** | (2006.01) |
| ***F28D 1/053*** | (2006.01) |
| ***F28F 17/00*** | (2006.01) |
| *F24F 13/22* | (2006.01) |
| *F28B 9/08* | (2006.01) |

(52) U.S. Cl.

CPC ..... *F28F 1/128* (2013.01); *F25D 21/14* (2013.01); *F28D 1/05366* (2013.01); *F28F 17/005* (2013.01); *F24F 13/222* (2013.01); *F24F 2013/227* (2013.01); *F25D 2321/146* (2013.01); *F28B 9/08* (2013.01)

(58) Field of Classification Search

CPC ..... F28F 1/128; F28F 17/005; F25D 21/14; F25D 2321/146; F28D 1/05366; F28B 4/08; F24F 13/222; F24F 2013/227

USPC ..... 62/497

See application file for complete search history.

(56) References Cited

U.S. PATENT DOCUMENTS

| | | | | |
|---|---|---|---|---|
| 4,000,779 | A * | 1/1977 | Irwin | F24F 13/22 165/DIG. 197 |
| 9,746,232 | B2 | 8/2017 | Forrest | |
| 9,909,818 | B2 * | 3/2018 | Goodman | F28F 1/12 |
| 2016/0195345 | A1 * | 7/2016 | Schult | F28D 1/05366 62/286 |
| 2021/0318083 | A1 * | 10/2021 | Curtis | F28F 25/04 |

FOREIGN PATENT DOCUMENTS

| | | |
|---|---|---|
| EP | 2933597 B1 | 11/2016 |

* cited by examiner

*Primary Examiner* — Joel M Attey

(74) *Attorney, Agent, or Firm* — Dickinson Wright PLLC

(57) ABSTRACT

A heat exchanger that includes a first manifold; a second manifold; a plurality of refrigerant tubes configured to fluidically couple the first and second manifolds; a plurality of fins placed between the plurality of refrigerant tubes, such that the fins and refrigerant tubes define a core having a plurality of open channels that allow air to flow there through; and a water-shedding device positioned approximate to the first manifold with a separation distance being maintained there between. At least a portion of the water-shedding device extends into one or more fin free windows located between the plurality of refrigerant tubes, such that condensate is extracted from between the refrigerant tubes.

18 Claims, 3 Drawing Sheets

Figure 1 – Prior Art

WATER-SHEDDING DEVICE FOR EVAPORATOR CORES

FIELD

This disclosure relates generally to a heat exchanger having a core defined by a plurality of tubes and fins. More specifically, this disclosure relates to a heat exchanger that includes a device configured to assist in removing condensate from the evaporator core.

BACKGROUND

The statements in this section merely provide background information related to the present disclosure and may not constitute prior art.

Air conditioning and heat pump systems as used in most residential/commercial applications generally comprise a heat exchanger that includes an inlet manifold, an outlet manifold, a plurality of extruded multi-port refrigerant tubes, which hydraulically connect the manifolds for refrigerant flow there between, and corrugated fins disposed between the refrigerant tubes. The corrugated fins interconnect adjacent refrigerant tubes in order to enhance both heat transfer efficiency and structural integrity. The plurality of refrigerant tubes and interconnecting corrugated fins typically define the core of the heat exchanger. The refrigerant tubes are conventionally aligned in a parallel and upright orientation with respect to the direction of gravity, while the corrugated fins are normally provided with louvers.

During operation, the heat exchanger may act as an evaporator. In other words, a two-phase refrigerant enters the lower portions of the refrigerant tubes from the inlet manifold and travels through the tubes expanding into a vapor phase as the refrigerant absorbs heat from the ambient air. As the airflow passes through the core of the heat exchanger, the temperature of the air decreases. When the temperature of the air falls below its dew point any moisture present in the air condenses onto the exterior surfaces of the refrigerant tubes and fins. If enough condensate accumulates, the condensate may occupy most of the space that exists between the refrigerant tubes and the fins resulting in an obstruction to the flow of air through the core and a reduction in the overall heat transfer efficiency of the heat exchanger. In addition, the interaction of the airflow and the condensate accumulated in the core may result in the dissipation of condensate droplets out of the core and into air plenums located downstream.

Although the above designs are commonly available, there exists a continual desire to increase the heat transfer efficiency of a heat exchanger by extracting and conveying condensate away from the core. Such an improvement may also be beneficial in minimizing the obstruction of airflow through the core and eliminating the ability of condensate droplets from reaching the air plenums.

SUMMARY

The present disclosure generally provides a heat exchanger that includes a device configured to remove condensate from an evaporator core defined by a plurality of tubes and fins. According to one aspect of the present disclosure, the heat exchanger comprises a first manifold; a second manifold; a plurality of refrigerant tubes configured to fluidically couple the first and second manifolds; a plurality of fins placed between the plurality of refrigerant tubes, such that the fins and refrigerant tubes define a core having a plurality of open channels that allow air to flow there through; and a water-shedding device positioned approximate to the first manifold with a separation distance being maintained there between. At least a portion of the water-shedding device extends into one or more fin free windows located between the plurality of refrigerant tubes, such that condensate is extracted from between the refrigerant tubes.

An advantage of the heat exchanger as disclosed herein is that it includes a device configured to assist in extracting and conveying condensate away from the core of the heat exchanger. The conveyance of condensate away from the core minimizes the occurrence of obstructed airflow through the core, thereby, enhancing heat transfer efficiency and reducing the potential for entrainment of any condensate in a downstream air conduit.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

The drawings described herein are for illustration purposes only and are not intended to limit the scope of the present disclosure in any way. It should be understood that throughout the description, corresponding reference numerals indicate like or corresponding parts and features.

DETAILED DESCRIPTION

The following description is merely exemplary in nature and is in no way intended to limit the present disclosure or its application or uses. For example, the water shedding device made and used according to the teachings contained herein is described throughout the present disclosure in conjunction with a heat exchanger used in a residential evaporator application in order to more fully illustrate the construction and the use thereof. The incorporation and use of such a water-shedding device in other heat exchangers in which a cold fluid flow tube has humid air passing over it, thereby, resulting in retained condensation, is contemplated not to exceed the scope of the present disclosure.

The present disclosure generally provides a heat exchanger having an improved heat transfer efficiency. One advantage of the heat exchanger as disclosed herein is that it includes a water-shedding device configured to assist in extracting and conveying condensate away from the core of the heat exchanger. The conveyance of condensate away from the core minimizes the occurrence of obstructed airflow through the core, thereby, enhancing the heat transfer efficiency and reducing the potential for entrainment of any condensate in a downstream air conduit. The water-shedding device may be added or retrofitted to any existing heat exchanger of the type described herein. Thus, the water-shedding device may enhance drainage and improve efficiency of the heat exchanger with no change to the basic core design.

Figure 1:
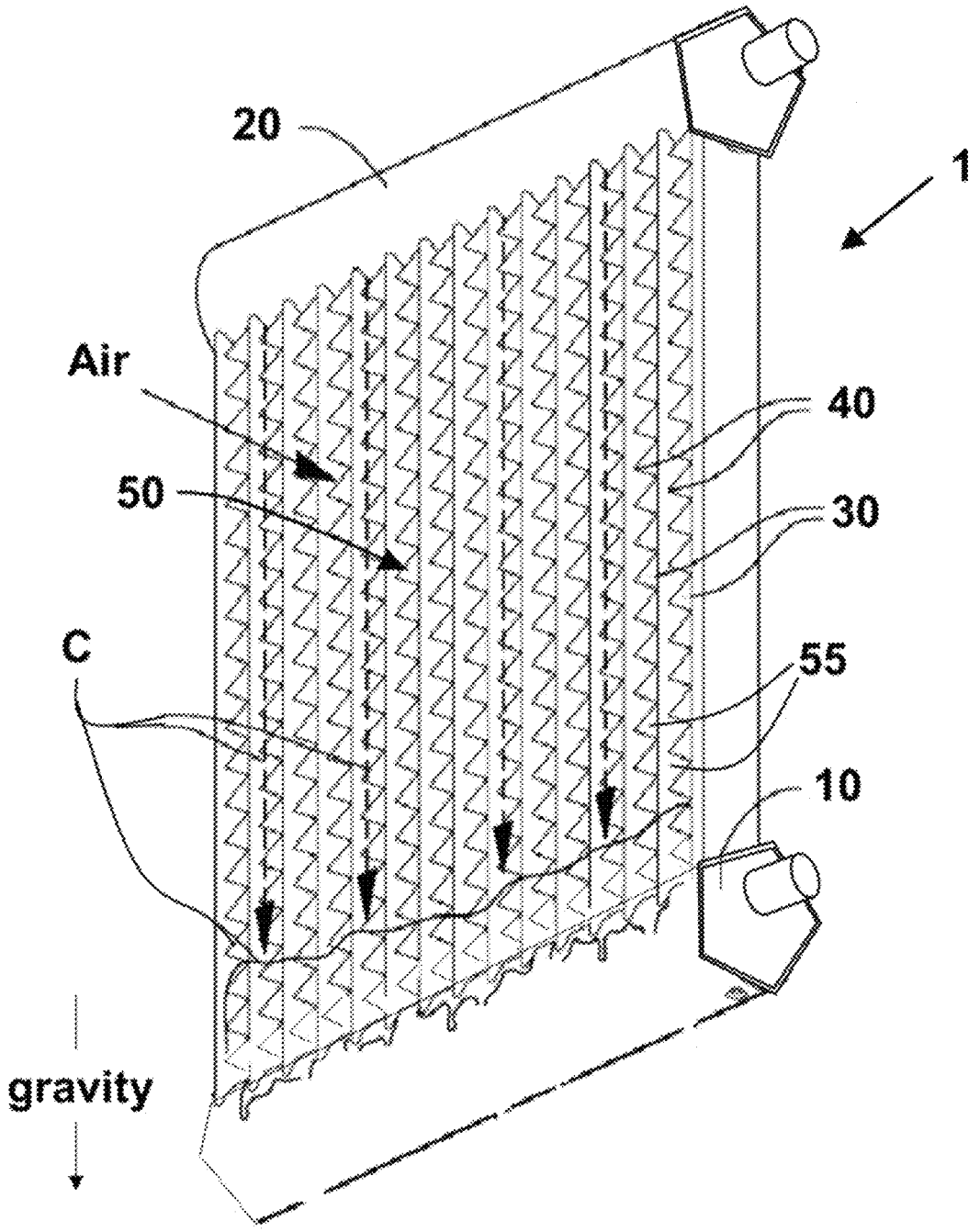
FIG. 1 is a schematic representation of a conventional heat exchanger having a core defined by a plurality of refrigerant tubes and fins.

Referring to FIG. 1, a conventional heat exchanger 1 includes an inlet manifold 10 and an outlet manifold 20 spaced apart in a substantially parallel relationship with the inlet manifold 10. A plurality of parallel refrigerant tubes 30 provide for fluidic communication between the inlet and outlet manifolds 10, 20. A plurality of corrugated fins 40 with or without louvers (not shown) inserted between adjacent refrigerant tubes 30 increase the heat transfer efficiency of the heat exchanger 1. The refrigerant tubes 30 and corrugated fins 40 define the core 50 of the heat exchanger 1. The exterior surfaces of the refrigerant tubes 30 in conjunction with the exterior surfaces of the corrugated fins 40 define a plurality of channels 55 for airflow through the core 50.

Still referring to FIG. 1, for a residential application of the heat exchanger assembly 1, the manifolds 10, 20 are typically oriented perpendicular to the direction of gravity, while the refrigerant tubes 30 are oriented perpendicular to the manifolds 10, 20. In other words the refrigerant tubes 30 are either oriented substantially in the direction of gravity or at the very minimum at least tilted toward the direction of gravity.

During operation in evaporative mode, a partially expanded two-phase refrigerant enters the lower portions of the refrigerant tubes 30 from the inlet manifold 10. As the refrigerant rises in the refrigerant tubes 30, it expands into a vapor phase by absorbing heat energy from the airflow that passes through the core 50 of the heat exchanger 1 via the airflow channels 55 located between the tubes 30 and fins 40. As energy in the form of heat transfers from the airflow to the refrigerant, the air becomes cooler. When the temperature of the air falls below the dew point, the moisture in the air condenses and accumulates on the exterior surfaces of the refrigerant tubes 30 and the fins 40. As the condensate begins to collect, gravity causes the condensate to flow towards the lower portion of the heat exchanger 1. The accumulation of condensate between adjacent refrigerant tubes 30 may result in the formation of a column of condensate (C) that can obstruct the flow of air through the core 50. Any obstruction of airflow through the core 50 reduces the heat transfer efficiency of the heat exchanger 1. In addition, the high velocity of the airflow across the face of the heat exchanger 1 can launch condensate droplets out of the core into the downstream air plenums.

Figure 2:
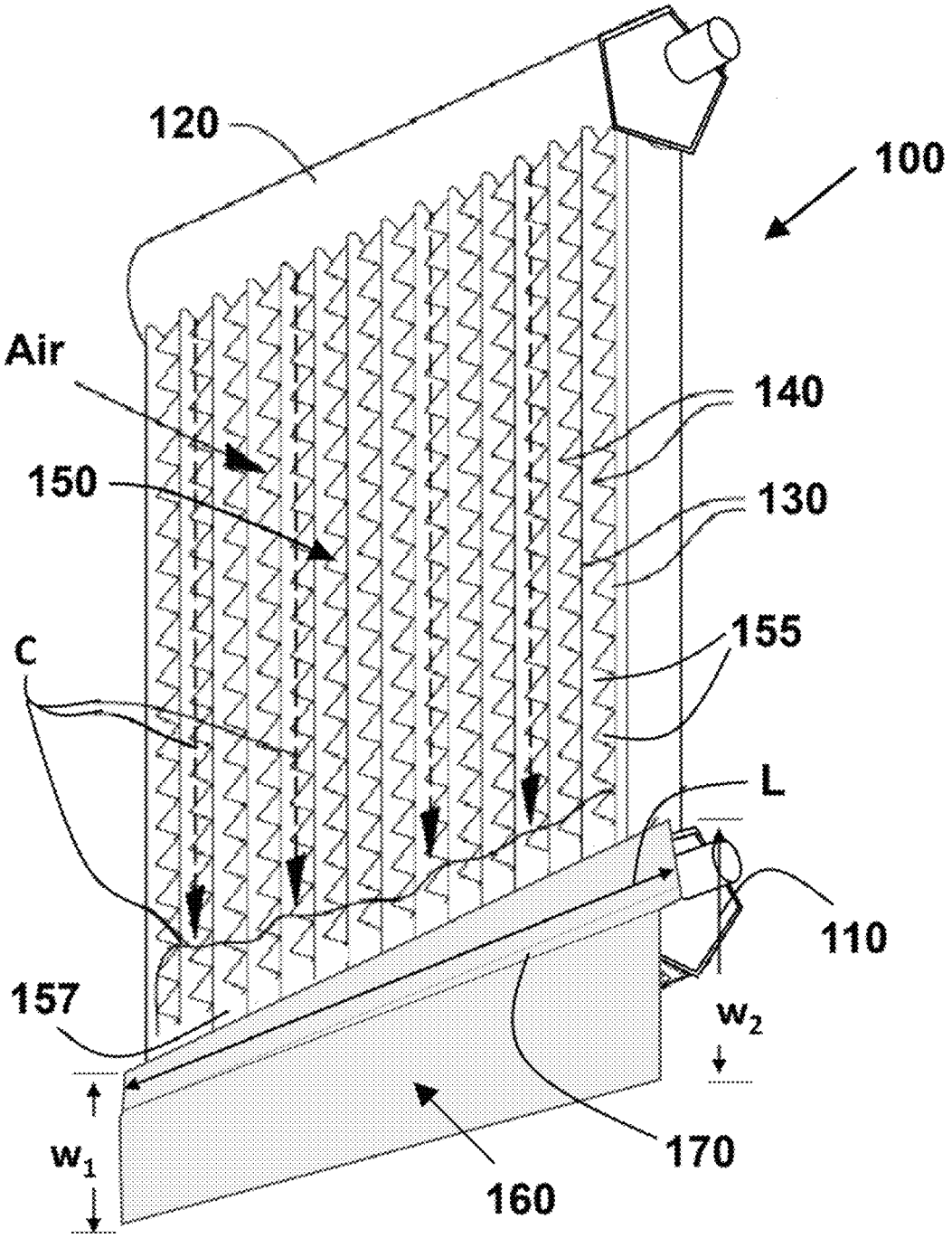
FIG. 2 is a schematic representation of a heat exchanger equipped with a water-shedding device according to the teachings of the present disclosure.
Figure 3:
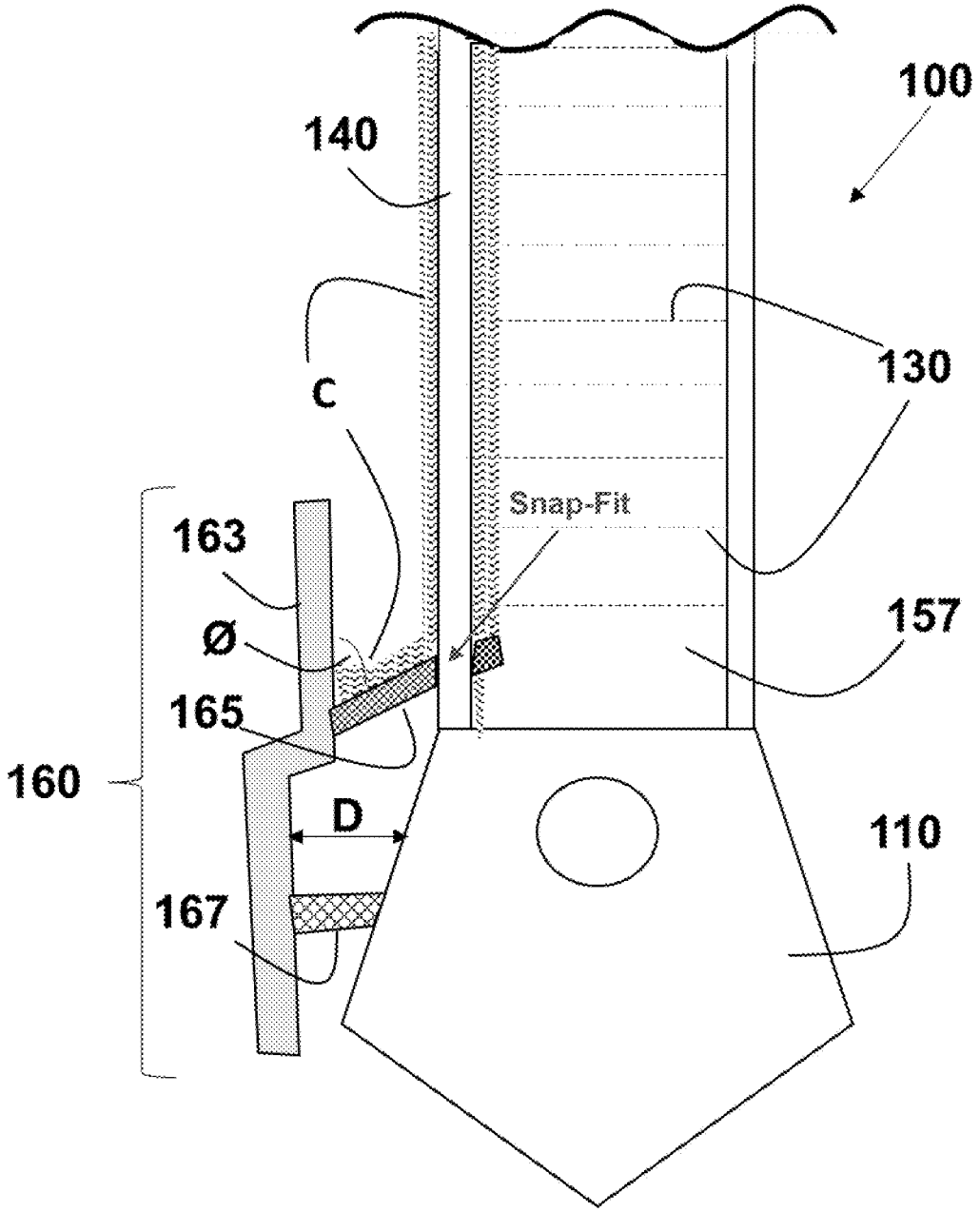
FIG. 3 is a cross-sectional view of a portion of the heat exchanger of FIG. 2 that includes the water-shedding device.

Referring now to FIGS. 2 and 3, the heat exchanger 100 of the present disclosure generally comprises a first manifold 110, a second manifold 120, a plurality of refrigerant tubes 130, a plurality of fins 140, and a water-shedding device 160. The plurality of refrigerant tubes 130 are configured to fluidically couple the first and second manifolds 110, 120. The plurality of fins 140 are placed between the plurality of refrigerant tubes 130, such that the fins 140 and refrigerant tubes 130 define a core 150 having a plurality of open channels 155 that allow air to flow there through. The water-shedding device 160 is positioned approximate to the first manifold 110 with a separation distance (D) being maintained there between. At least a portion of the water-shedding device 160 extends into one or more fin free windows 157 located between the plurality of refrigerant tubes 130, such that condensate (C) is extracted from between the refrigerant tubes 130.

A first manifold 110 and the second manifold 120 are spaced apart in a substantially parallel relationship to one another. The plurality of refrigerant tubes 130, which fluidically connect the first manifold 130 and second manifold 140, are oriented substantially in the direction of gravity or at least tilted toward the direction of gravity. Alternatively, the plurality of refrigerant tubes 130 are oriented perpendicular to the manifolds 110, 120.

The plurality of fins 140, which generally include alternating ridges, are inserted between adjacent refrigerant tubes 130. The alternating ridges of the fins 140 are in contact with the exterior surfaces of the adjacent refrigerant tubes 130. When desirable, the fins 140 may be corrugated and/or include louvers (not shown) in order to increase heat transfer efficiency and to facilitate condensate drainage along the length of the refrigerant tubes 130.

The plurality of refrigerant tubes 130 and fins 140 between adjacent refrigerant tubes 130 define the heat exchanger core 150. The core 150 of the heat exchanger 100 includes a plurality of airflow channels 155 for airflow through the core 150. The airflow through the fins 140 is directed between adjacent airflow channels 155. The refrigerant tubes 130 and fins 140 may be formed from any known heat conductive material, including, but not limited to a metal or metal alloy, such as aluminum for example. The manifolds 110, 120, refrigerant tubes 130, and fins 140 may be assembled into the heat exchanger 100 and brazed by any method known in the art to provide a solid, liquid tight heat exchanger 100.

Referring now to FIG. 3, the heat exchanger 100 includes a water-shedding device 160 that is located approximate to the first manifold 110, but at a spatial distance (D) with respect to the first manifold 110. This spatial distance (D) is maintained along the length (L) of the water-shedding device 160. The water-shedding device 160 generally comprises a panel 163 having a plurality of armatures 165 extending from one side of the panel 163. These armatures 165 represent the portion of the water-shedding device 160 that extends into the one or more fin free windows 157.

The panel 163 and the plurality of armatures 165 are individually selected to be a plastic molded part, a plastic thermoformed part; or a part formed from a metal or metal alloy. Thus, the panel 163 and the plurality of armatures 165 of the water-shedding device 160 may be integrally formed or fastened to the panel 163. The process for fastening the armatures 165 to the panel 163 may include, without limitation, brazing, soldering, and/or the use of adhesives. The formation of an integral part comprising the panel 163 and armatures 165 may be accomplished by any known method, including but not limited to injection molding, blow molding, thermoforming, casting, or metal stamping.

Referring once again to FIG. 2, the water-shedding device 100 includes a first end having width $w_1$ and a second end having width $w_2$. The width $w_2$ of the second end is greater than the width $w_1$ of the first end. Thus, an angled gradient 170 is created along the length (L) of the water-shedding device 160 and the extracted condensate flows down the gradient 170. This gradient 170 may act as a trough positioned at an angle, wherein it functions similar to a drain gutter using gravity to convey the condensate away from the core 150.

As best shown in FIG. 3, one or more of the plurality of armatures 165 forms an angle (θ) with the panel 163 that is less than or equal to 90°. Alternatively, the angle (θ) is greater than 1° and less than or equal to 90°; alternatively, greater than 5°; alternatively, greater than 10°; alternatively, less than 85°; alternatively, less than 75°; alternatively, about 60° or about 45°. These armatures may form at least a portion of the gradient 170 along the length (L) of the panel 163, wherein they are configured to assist in the flow of condensate away from the refrigerant tubes 130. The armatures 165 may be differently shaped, so long as they provide a drainage path for condensate to be extracted from the core 150. When desirable, localized, inwardly protruding features may be provided as part of the armatures 165 in order to aid in disrupting the surface tension of the condensate and/or breaking the meniscus films in order for the condensate to be extracted from between the refrigerant tubes 130.

The plurality of the armatures 165 may be configured to fasten the water-shedding device 160 to the heat exchanger 100. Any type of known fastening method or fastener may be used for this purpose, including, without limitation, brazing, soldering, the application of an adhesive, or the use of a snap-fit fastener. Alternatively, at least one of the plurality of armatures 165 that fasten the water-shedding device 160 to the heat exchanger 100 is a snap-fit fastener. In this manner, the plurality of armatures 165 may provide a sealing engagement against the exterior surfaces of the refrigerant tubes 130 to prevent condensate from continuing to travel down the core 150 and to extract the condensate from between the refrigerant tubes 140.

According to another aspect of the present disclosure, the water-shedding device 160 as shown in FIG. 3 may further comprise one or more spacers 167 configured to maintain the separation distance (D) from the manifold 110. The one or more spacers 167 may be integrally formed with at least one of the plurality of armatures 165 and/or the panel 163. Alternatively, the one or more spacers 167 may be fastened to at least one of the panel 163 and/or the plurality of armatures 165. Any type of known fastening method or fastener may be used for this purpose, including, without limitation, brazing, soldering, or the application of an adhesive.

For the purpose of this disclosure the terms "about" and "substantially" are used herein with respect to measurable values and ranges due to expected variations known to those skilled in the art (e.g., limitations and variability in measurements).

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one manifold", "one or more manifolds", and "manifold(s)" may be used interchangeably and are intended to have the same meaning.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A heat exchanger comprising:

a first manifold;

a second manifold;

a plurality of refrigerant tubes configured to fluidically couple the first and second manifolds;

a plurality of fins placed between the plurality of refrigerant tubes, such that the fins and refrigerant tubes define a core having a plurality of open channels that allow air to flow there through; and a water-shedding device positioned approximate to the first manifold with a separation distance being maintained there between; wherein at least a portion of the water-shedding device extends into one or more fin free windows located between the plurality of refrigerant tubes, such that condensate is extracted from between the refrigerant tubes;

wherein the water-shedding device includes a first end having width $w_1$ and a second end having width $w_2$ wherein $w_2>w_1$, such that an angled gradient is created and the extracted condensate flows down the gradient.

2. The heat exchanger according to claim 1, wherein the water-shedding device comprises a panel having a plurality of armatures extending from one side of the panel, the armatures being the portion of the water-shedding device that extends into the one or more fin free windows.

3. The heat exchanger according to claim 2, wherein the panel and the plurality of armatures of the water-shedding device are integrally formed or the plurality of armatures are fastened to the panel.

4. The heat exchanger according to claim 2, wherein the panel and the plurality of armatures are individually selected to be a plastic molded part, a plastic thermoformed part; or a part formed from a metal or metal alloy.

5. The heat exchanger according to claim 2, wherein the water-shedding device further comprises one or more spacers configured to maintain the separation distance;

wherein the one or more spacers are integrally formed with at least one of the plurality of armatures and the panel or the one or more spacers are fastened to at least one of the panel and the plurality of armatures.

6. The heat exchanger according to claim 2, wherein one or more of the plurality of armatures and the panel form an angle (Ø) that is less than or equal to 90°.

7. The heat exchanger according to claim 2, wherein a plurality of the armatures are configured to fasten the water-shedding device to the heat exchanger.

8. The heat exchanger according to claim 1, wherein the plurality of armatures forms the gradient along the length (L) of the panel.

9. The heat exchanger according to claim 7, wherein at least one of the plurality of armatures that fasten the water shedding device to the heat exchanger is a snap-fit fastener.

10. A water-shedding device for use with a heat exchanger that includes a core defined by a plurality of refrigerant tubes and fins located between first and second manifolds, the water-shedding device configured such that a separation distance is maintained when the device is fastened to the first manifold, and at least a portion of the water-shedding device extends into one or more fin free windows located between the plurality of refrigerant tubes, such that condensate is extracted from between the refrigerant tubes;

wherein the water-shedding device includes a first end having width $w_1$ and a second end having width $w_2$, wherein $w_2>w_1$, such that an angled gradient is created and the extracted condensate flows down the gradient.

11. The water-shedding device according to claim 10, wherein the water-shedding device comprises a panel having a plurality of armatures extending from one side of the panel, the armatures being the portion of the water-shedding device that extends into the one or more fin free windows.

12. The water-shedding device according to claim 11, wherein the panel and the plurality of armatures of the water-shedding device are integrally formed or the plurality of armatures are fastened to the panel.

13. The water-shedding device according to claim 11, wherein the panel and the plurality of armatures are individually selected to be a plastic molded part, a plastic thermoformed part; or a part formed from a metal or metal alloy.

14. The water-shedding device according to claim 11, wherein the water-shedding device further comprises one or more spacers configured to maintain the separation distance; wherein the one or more spacers are integrally formed with at least one of the plurality of armatures and the panel or the one or more spacers are fastened to at least one of the panel and the plurality of armatures.

15. The water-shedding device according to claim 11, wherein one or more of the plurality of armatures and the panel form an angle (Ø) that is less than or equal to 90°.

16. The water-shedding device according to claim 11, wherein a plurality of the armatures are configured to fasten the water-shedding device to the heat exchanger.

17. The water-shedding device according to claim 10, wherein the plurality of armatures forms the gradient along the length (L) of the panel.

18. The water-shedding device according to claim 16, wherein at least one of the plurality of armatures that fasten the water shedding device to the heat exchanger is a snap-fit fastener.

* * * * *